US006368161B1

(12) United States Patent
Lin

(10) Patent No.: US 6,368,161 B1
(45) Date of Patent: Apr. 9, 2002

(54) LAMP HOLDER FOR DECORATIVE LIGHTING DEVICE

(75) Inventor: Chang-Yuan Lin, Hsin-Chu (TW)

(73) Assignee: Yuan Mei Decorative Lamp & Painting Co., Ltd. (TW)

( * ) Notice: Subject to any disclaimer, the term of this patent is extended or adjusted under 35 U.S.C. 154(b) by 0 days.

(21) Appl. No.: 09/567,621

(22) Filed: May 9, 2000

(30) Foreign Application Priority Data

Apr. 11, 2000 (TW) ..... 89205792 U

(51) Int. Cl.[7] ..... H01R 24/00; H01K 1/00

(52) U.S. Cl. ..... 439/699.2; 439/619

(58) Field of Search ..... 439/699.2, 619, 439/280, 656, 243, 617, 602; 362/226, 249

(56) References Cited

U.S. PATENT DOCUMENTS 2,032,451 A * 3/1936 Tighe
5,795,189 A * 8/1998 Liou ..... 439/602
5,816,862 A * 10/1998 Tseng ..... 439/699.2
5,820,419 A * 10/1998 Liao ..... 439/699.2
5,989,068 A * 11/1999 Shu ..... 439/619
6,213,433 B1 * 9/2000 Chen ..... 362/226

* cited by examiner

*Primary Examiner*—Neil Abrams
*Assistant Examiner*—Chandrika Prasad
(74) *Attorney, Agent, or Firm*—Harness, Dickey & Pierce, P.L.C.

(57) ABSTRACT

A decorative lighting device includes a miniature incandescent lamp, a plug-in base, a partition member, right and left urging lugs, and a housing. The miniature incandescent lamp is held in the plug-in base. The partition member is integrally formed with a bottom wall of the plug-in base. The right and left urging lugs are disposed on opposite sides of the partition member. The housing includes an upper end wall having an opening for passage of the plug-in base, a lower end wall having a slot adapted to receive two electric leads, and an inner intermediate circumferential wall communicating the upper and lower end walls. When the plug-in base, together with the miniature incandescent lamp, is inserted into the housing, lead-in wires of the miniature incandescent lamp and the electric leads will be firmly clamped between the intermediate circumferential wall and the right and left urging lugs to ensure good electrical contact and to prevent entrance of rainwater thereinto.

6 Claims, 6 Drawing Sheets

LAMP HOLDER FOR DECORATIVE LIGHTING DEVICE

BACKGROUND OF THE INVENTION

1. Field of the Invention

The invention relates to a decorative lighting device, more particularly to a decorative lighting device that is easy to assemble, that ensures good electrical contact, and that has an enhanced waterproof effect.

2. Description of the Related Art

FIG. 1 illustrates a conventional decorative lighting device. As shown, the conventional decorative lighting device includes a lamp holder 10, a miniature incandescent lamp 11 mounted in the lamp holder 10, and a housing 12 having a hole 121. Two lead-in wires 111, 112 of the miniature incandescent lamp 11 pass into and extend outwardly of the lamp holder 10. After electrically connecting the lead-in wires 111, 112 of the miniature incandescent lamp 11 to a contact ends 151 of leads 15 that are predisposed in and that extend out of the hole 121 in the housing 12, the lamp holder 10 is inserted into the hole 121 via a top portion of the housing 12 to complete the assembly.

Although the housing 12 can conceal the electrical contacts in the hole 121 to prevent occurrence of short-circuit due to strong winds, during assembly, since the part of the lamp holder 10 that is inserted into the hole 121 is cylindrical, the contact ends 151 of the leads 15 have to pass through the housing 12 to be electrically connected to the lead-in wires 111, 112 of the lamp 11 before the lamp holder 10 can be fitted into the hole 121 in the housing 12. As such, the contact ends 151 of the leads 15 will not slant to one side, which may result in interrupted electrical connection. Assembly is therefore time—and labor-consuming.

Furthermore, since the hole 121 in the housing 12 has a consistent bore and a rear end thereof is provided with an opening 122 of a consistent bore, the other end of each of the two leads 15 that are connected to the lead-in wires 111, 112 can extend outwardly of the housing 12, leaving a relatively large space in the hole 121 that only accommodates a part of the lamp holder 10. When the decorative lighting device is installed outdoors and is subjected to rain, the rain water may penetrate thereinto via the opening 122 at the rear end of the housing 12, which will affect the electrical connection between the leads 15 and the lead-in wires 111, 112 and result in short-circuit. It can therefore be seen that such a conventional decorative lighting device does not have any waterproof effect, and the housing thereof does not provide good protection.

Furthermore, since the leads 15 are electrically connected to their respective lead-in wires 111, 112 and are not secured by any means, they may become detached easily when subjected to an external force, so that electrical connection is affected, and the service life of the decorative lighting device is accordingly shortened.

In the conventional lighting device described above, due to the configuration of the lamp holder 10 and the miniature incandescent lamp 11, a light transmissive member 16 can only be fitted externally of the housing 12 to enclose and conceal the miniature incandescent lamp 11 therein. However, the light transmissive member 16 that is fitted externally of the housing 12 is likely to become detached when subjected to an external force.

SUMMARY OF THE INVENTION

Therefore, the main object of the present invention is to provide a decorative lighting device that ensures positive electrical contact and that prevents entrance of rainwater thereinto.

Another object of the present invention is to provide a decorative lighting device that includes a light transmissive member having an annular edge portion that can abut against a plug-in base holding a miniature incandescent lamp when the light transmissive member is coupled with a housing, thereby ensuring good electrical contact.

A further object of the present invention is to provide a decorative lighting device that facilitates lamp replacement.

According to the present invention, the decorative lighting device includes a miniature incandescent lamp, a plug-in base, a partition member, right and left urging lugs, and a housing. The miniature incandescent lamp includes upper and lower portions opposite to each other in an axial direction, and first and second lead-in wires extending downwardly and outwardly of the lower portion. The plug-in base is disposed to receive the lower portion therein, and includes a bottom wall that is disposed distal to the upper portion in the axial a direction, and that extends in a first direction transverse to the axial direction. The bottom wall has right and left through holes spaced apart from each other in the first transverse direction. The second and first lead-in wires respectively pass through the right and left through holes to extend downwardly and outwardly of the bottom wall. The partition member has an upper end integrally formed with the bottom wall of the plug-in base and interposed between the right and left through holes, a lower end extending downwardly from the upper end in the axial direction, and right and left facing walls that are opposite to each other in the first transverse direction, and that are respectively proximate to the second and first lead-in wires. The partition member further has front and rear abutting walls opposite to each other in a second direction transverse to both of the first transverse direction and the axial direction. Each of the right and left facing walls and the front and rear abutting walls extends from the upper end to the lower end. The right and left urging lugs are respectively disposed on the right and left facing walls to permit the second and first lead-in wires led out of the bottom wall to be disposed outboard to the right and left urging lugs in the first transverse direction. The housing includes an upper end wall, a lower end wall, and an inner intermediate circumferential wall. The upper end wall confines an opening for passage of the plug-in base. The lower end wall is opposite to the upper end wall in the axial direction, and includes an inner peripheral portion defining a slot that is adapted to receive two insulated electric leads inserted therein. Each of the insulated electric leads has a contact end that extends through the slot towards the upper end wall. The inner intermediate circumferential wall defines a passageway extending in the axial direction to communicate the opening with the slot. The inner peripheral portion includes front and rear grip surfaces that are spaced apart from each other in the second transverse direction by a distance such that when the plug-in base is inserted into the housing via the opening, the partition member is guided along the passageway with the front and rear abutting walls thereof oriented to mate with and to be retained by the front and rear grip surfaces, respectively, so as to divide the slot into two separate inserting holes adapted for passage of the insulated electric leads therethrough. The inner intermediate circumferential wall and each of the right and left facing walls confine a receiving channel for accommodating each of the contact ends extending thereinto. The right and left urging lugs respectively urge the second and first lead-in wires outwardly in the first transverse direction such that the second and first lead-in wires abut against the contact ends extended into the receiving channels and such that the second and first lead-in wires and the contact ends are clamped between the intermediate circumferential wall and the right and left urging lugs.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
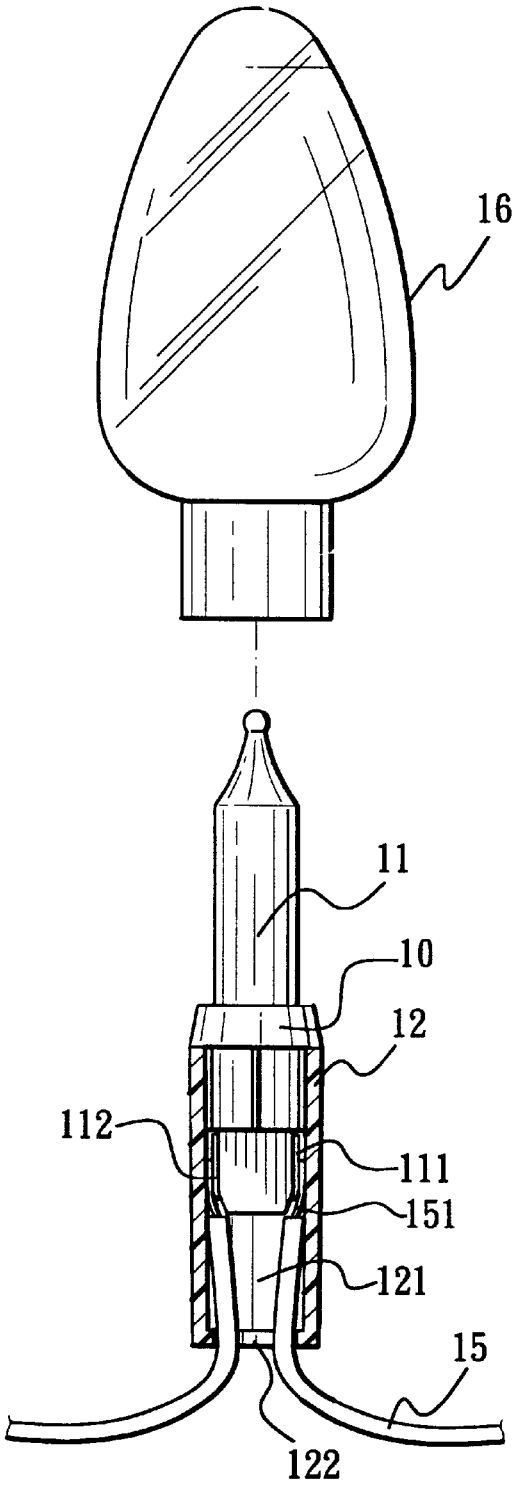
F I G. 1 PRIOR ART
FIG. 1 is a partly exploded sectional view of a decorative lighting device of the prior art.

Before the present invention is described in greater detail, it should be noted that like elements are denoted by the same reference numerals throughout the disclosure.

Figure 2:
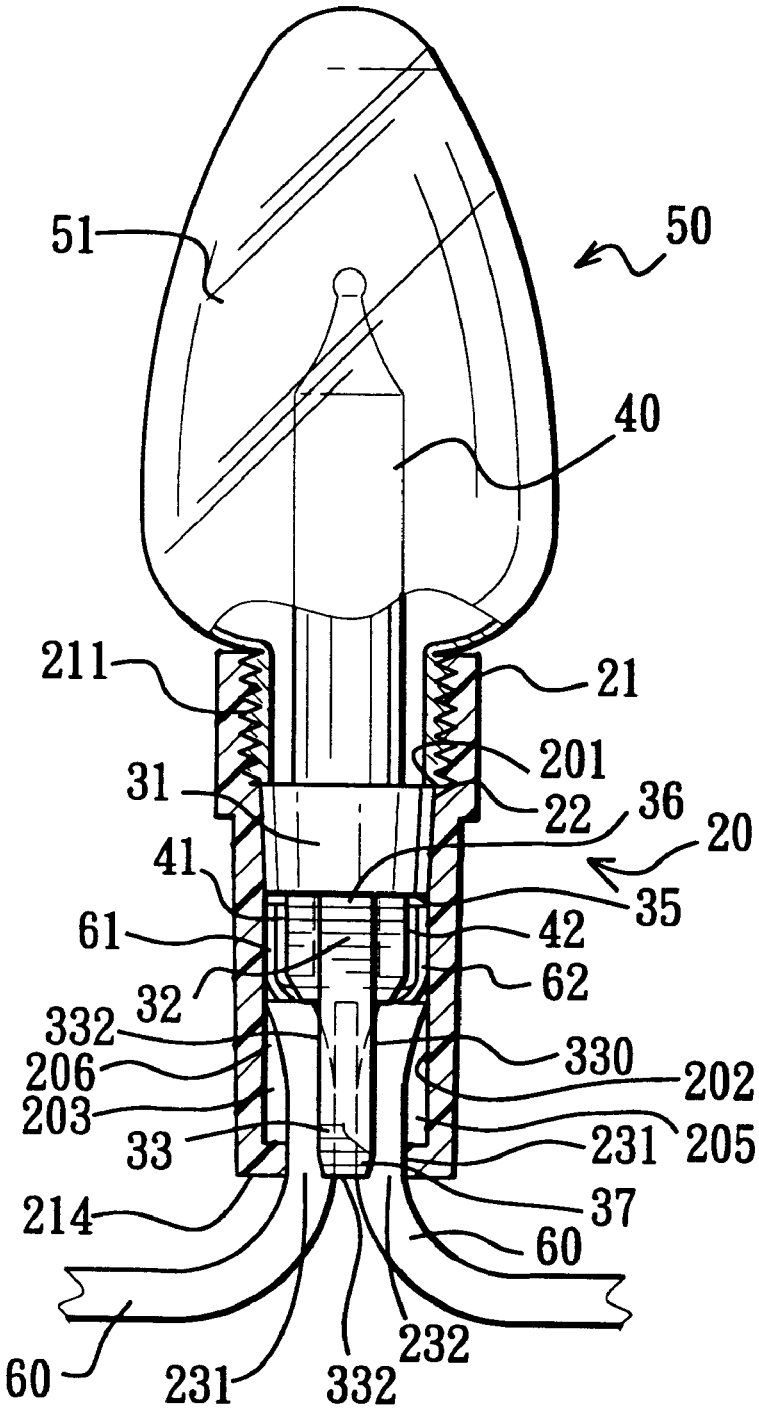
FIG. 2 is an assembled partly sectional schematic view of a preferred embodiment of a decorative lighting device according to the invention.
Figure 3:
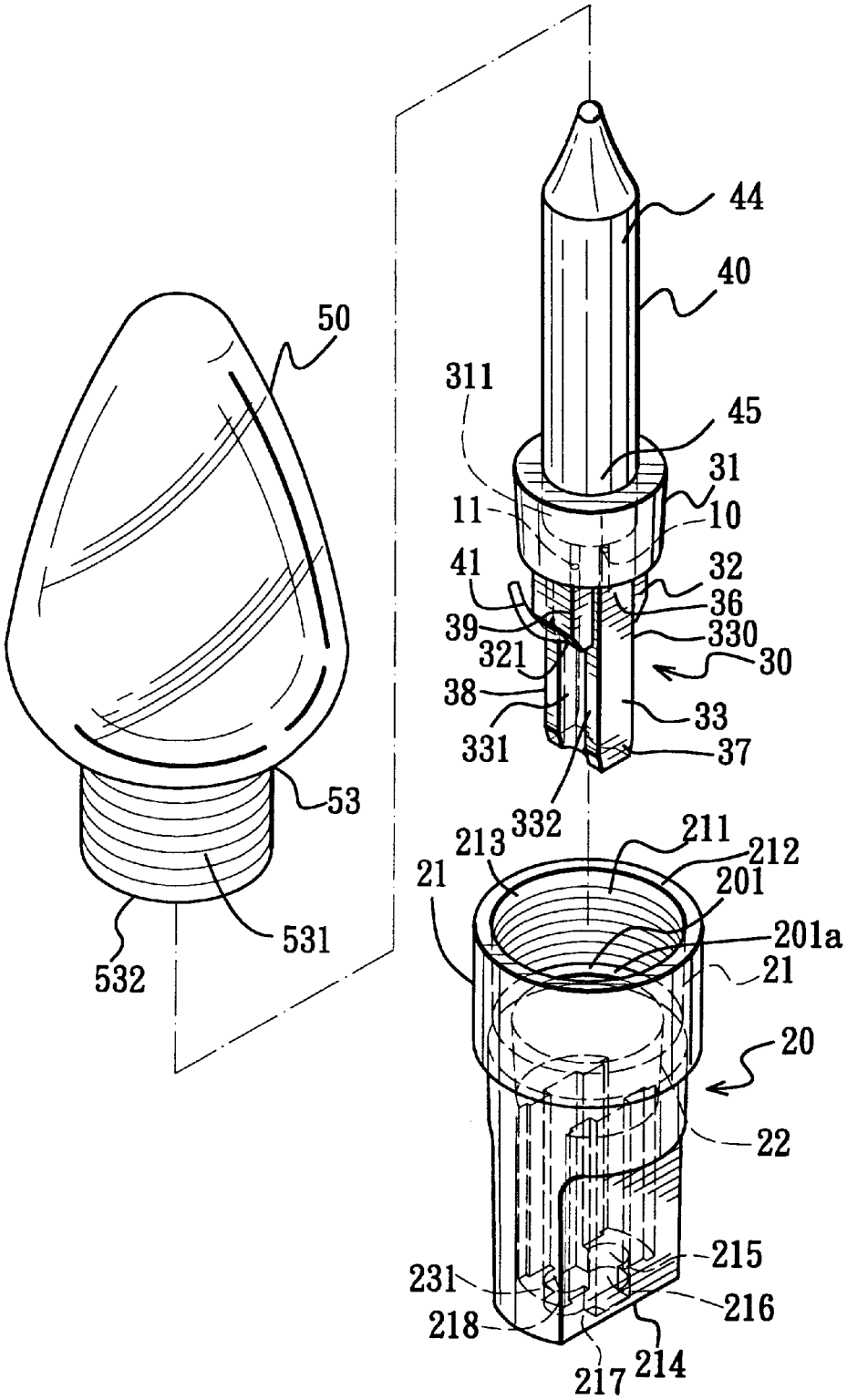
FIG. 3 is an exploded perspective view of the preferred embodiment.
Figure 4:
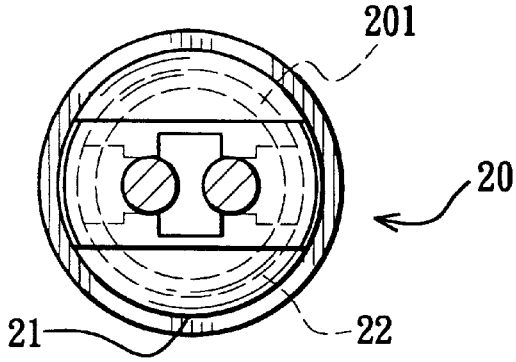
FIG. 4 is a bottom schematic view of a housing of the preferred embodiment.

Referring to FIGS. 2, 3, and 4, the first preferred embodiment of a decorative lighting device according to the present invention is shown to include a miniature incandescent lamp 40, a plug-in base 31, a partition member 30, right and left urging lugs 32, 39, and a housing 20.

The miniature incandescent lamp 40 includes upper and lower portions 44, 45 opposite to each other in an axial direction, and first and second lead-in wires 41, 42 extending downwardly and outwardly of the lower portion 45.

The plug-in base 31 includes a lamp-receiving recess 311 for receiving the lower portion 45 of the miniature incandescent lamp 40 therein, and a bottom wall 35 that is disposed distal to the upper portion 44 in the axial direction, and that extends in a first direction transverse to the axial direction. The bottom wall 35 has right and left through holes 10, 11 that are spaced apart from each other in the first transverse direction, and that are communicated with the lamp-receiving recess 311. The second and first lead-in wires 42, 41 respectively pass through the right and left through holes 10, 11 to extend downwardly and outwardly of the bottom wall 35.

The partition member 30 has an upper end 36, a lower end 37, right and left facing surfaces 330, 332, and front and rear abutting surfaces 33, 38. The upper end 36 is integrally formed with the bottom wall 35 of the plug-in base 31, and is interposed between the right and left through holes 10, 11. The lower end 37 extends downwardly from the upper end 36 in the axial direction. The right and left facing surfaces 330, 332 are opposite to each other in the first transverse direction, and are respectively proximate to the second and first lead-in wires 42, 41. Each of the right and left facing surfaces 330, 332 extends from the upper end 36 to the lower end 37. The front and rear abutting surfaces 33, 38 are opposite to each other in a second direction transverse to both of the first transverse direction and the axial direction. Each of the front and rear abutting surfaces 33, 38 extends from the upper end 36 to the lower end 37.

The right and left urging lugs 32, 39 are respectively disposed on the right and left facing surfaces 330, 332 of the partition member 30, and include bottom through holes 321 that are communicated with the through holes 10, 11 in the bottom wall 35 of the plug-in base 31. Due to the arrangement of the right and left urging lugs 32, 39, when the miniature incandescent lamp 40 is inserted into the lamp-receiving recess 311 of the plug-in base 31, the second and first lead-in wires 42, 41 passing through the through holes 10, 11 in the bottom wall 35 and the bottom through holes 321 in the right and left urging lugs 32, 39 are disposed outboard to the right and left urging lugs 32, 39 in the first transverse direction.

The housing 20 includes an upper end wall 212, a lower end wall 214, and an inner intermediate circumferential surface 202. The upper end wall 212 confines an opening 213 for passage of the plug-in base 31. The lower end wall 214 is opposite to the upper end wall 212 in the axial direction, and includes an inner peripheral portion 215 defining a slot 216. The slot 216 is adapted to receive two insulated electric leads 60, inserted therein. The insulated electric leads 60 have respective contact ends 61, 62 that extend through the slot 216 towards the upper end wall 212. The inner intermediate circumferential surface 202 defines a passageway 203 extending in the axial direction to communicate the opening 213 with the slot 216.

The inner peripheral portion 215 includes front and rear grip surfaces 217, 218 that are spaced apart from each other in the second transverse direction by a distance such that when the plug-in base 31 is inserted into the housing 20 via the opening 213, the partition member 30 is guided along the passageway 203 with the front and rear abutting surfaces 33, 38 thereof oriented to mate with and to be retained by the front and rear grip surfaces 217, 218, respectively, so as to divide the slot 216 into two separate inserting holes 231, 232. The inserting holes 231, 232 are adapted for passage of the insulated electric leads 60 therethrough. The inner intermediate circumferential surface 202 and the right and left facing surfaces 330, 332 together confine two receiving channels 205, 206 for accommodating the contact ends 61, 62 extending thereinto, respectively. The right and left urging lugs 32, 39 respectively urge the second and first lead-in wires 41, 42 outwardly in the first transverse direction such that the second and first lead-in wires 41, 42 abut against the contact ends 61, 62 extended into the receiving channels 205, 206, and such that the second and first lead-in wires 42, 41 and the contact ends 61, 62 are clamped between the intermediate circumferential surface 202 and the right and left urging lugs 32, 39. The front and rear grip surfaces 217, 218 respectively extend upwardly along the inner intermediate circumferential surface 202 in the axial direction and are disposed to be in a key-and-keyway engagement with the front and rear abutting surfaces 33, 38 of the partition member 30, respectively.

The housing 20 further includes an annular shoulder portion 201 that is disposed on and that extends inwardly and radially from the inner intermediate circumferential surface 202. The annular shoulder portion 201 and the opening 213 confines an upper annular socket portion 21 having a first dimension and a lower annular socket portion 22 having a second dimension which is smaller than the first dimension such that an annular seat 201 a is defined between the socket portions 21, 22 in the axial direction. The second dimension is such that the plug-in base 31 can be pressed fittingly into the lower annular socket portion 22.

The decorative lighting device further includes a light transmissive member 50. The light transmissive member 50 has a transmissive body 51 that confines a hollow chamber therein for enclosing the miniature incandescent lamp 40, and an annular neck portion 53 integrally formed with the transmissive body 51 and disposed to provide access to the hollow chamber. The annular neck portion 53 is sized to fit into the upper annular socket portion 21.

Figure 5:
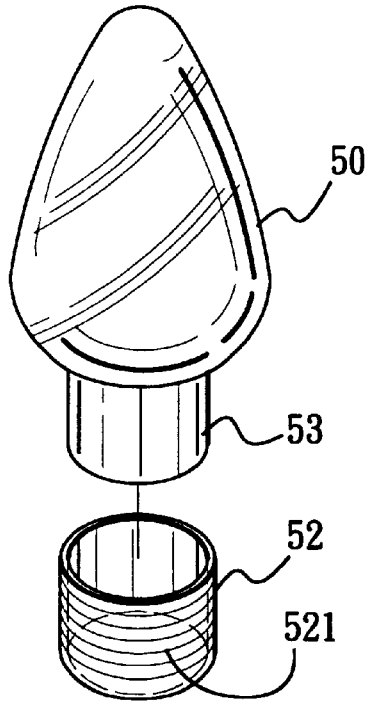
FIG. 5 is an exploded perspective view illustrating a modified embodiment of a light transmissive member.

The annular neck portion 53 of the light transmissive member 50 includes an annular edge portion 532 distal to the transmissive body 51 and disposed to sit on the annular seat 201*a* and to abut against the plug-in base 31 when the annular neck portion 53 is fitted into the upper annular socket portion 213 of the housing 20. With reference to FIG. 3, the annular neck portion 53 may be integrally formed with external threads 531, while the upper annular socket portion 21 of the housing 20 is correspondingly provided with internal threads 211 for threaded engagement with the IS external threads 531. Alternatively, a plastic sleeve 52 having external threads 521 may be fitted over the annular neck portion 53, as shown in FIG. 5, to permit threaded engagement between the miniature incandescent lamp 40 and the housing 20.

Furthermore, each of the right and left facing surfaces 330, 332 of the partition member 30 includes a guide groove 331. The guide groove 331 extends from the upper end 36 to the lower end 37 of the partition member 30, and is adapted to guide insertion of the respective one of the insulated electric leads 60, 60.

The plug-in base 31, the partition member 30, the right and left urging lugs 32, 39, and the housing 20 are preferably formed from a thermoplastic material.

Figure 6:
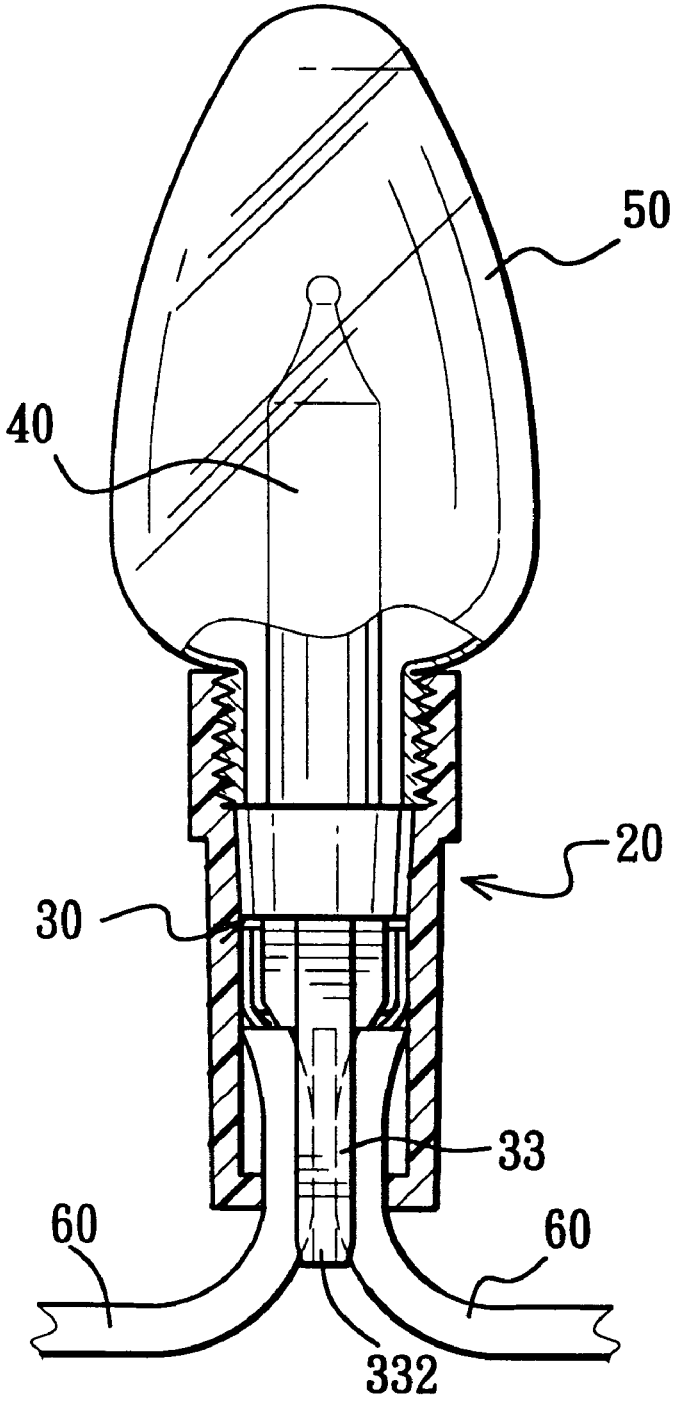
FIG. 6 is a partly sectional schematic view of the second preferred embodiment of the decorative lighting device according to the invention.

With reference to FIG. 6, which illustrates a modified embodiment of a decorative lighting device according to the present invention, the lower end 37 of the partition member 30 thereof can extend downwardly and outwardly of the lower end wall 214 of the housing.

Figure 7:
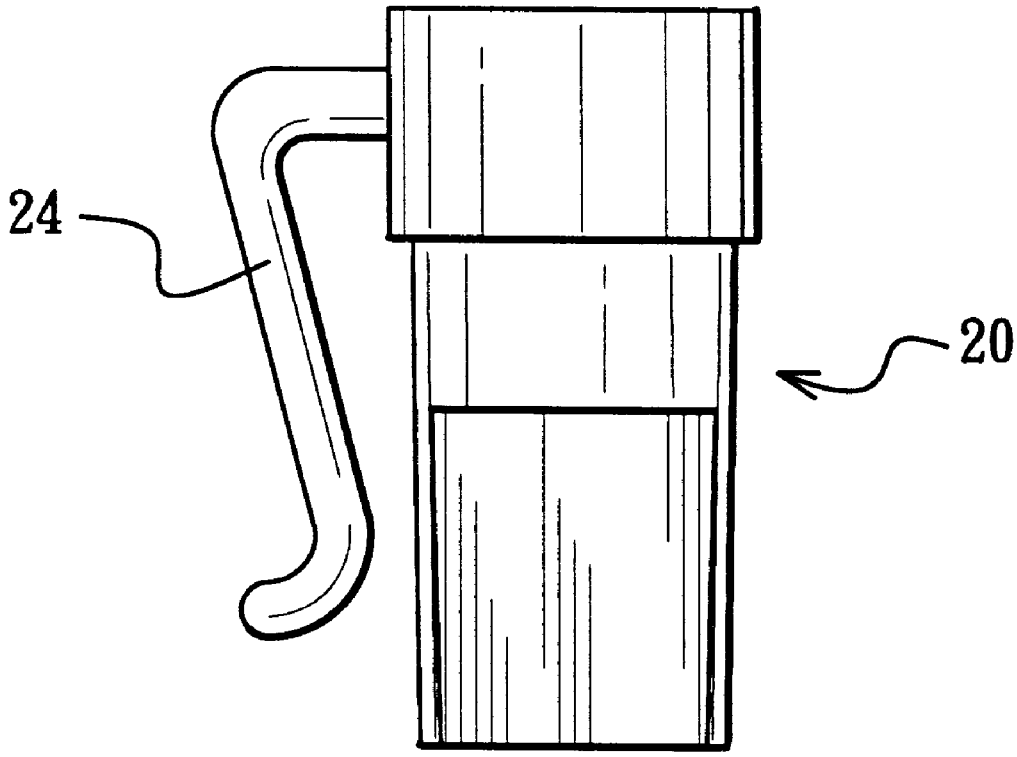
FIG. 7 is schematic view illustrating a modified embodiment of the housing, in which the housing is provided with a clip.

With reference to FIG. 7, which illustrates a modified embodiment of the housing 20, the housing 20 includes a clip 24 projecting therefrom for attachment to an object.

By means of the aforesaid construction of the decorative lighting device of the present invention, the lead-in wires 41, 42 and the contact ends 61, 62 of the insulated electric wires 60 are held firmly between the intermediate circumferential wall 202 and the right and left urging lugs 32, 39 to ensure good electrical contact, and the plug-in base 31 and the housing 20 can be firmly coupled to prevent entrance of rainwater thereinto. Besides, the annular edge portion 532 of the annular neck portion 531 of the light transmissive member 50 can abut against the plug-in base 31 when the annular neck portion 531 is fitted into the upper annular socket portion 21 of the housing 20 to firmly position the plug-in base 31 in the housing 20. In addition, since the lower end 37 of the partition member 30 can project downwardly and outwardly from the lower end wall 214 of the housing 20, the user can easily disengage the partition member 30 together with the plug-in base 31 that holds the miniature incandescent lamp 40 by pushing the lower end 37 upwardly for replacement of the miniature incandescent lamp 40.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A decorative lighting device comprising:

a miniature incandescent lamp including upper and lower portions opposite to each other in an axial direction, and first and second lead-in wires extending downwardly and outwardly of said lower portion;

a plug-in base disposed to receive said lower portion therein and including a bottom wall that is disposed distal to said upper portion in the axial direction, and that extends in a first direction transverse to the axial direction, said bottom wall having right and left through holes spaced apart from each other in the first transverse direction, said second and first lead-in wires respectively passing through said right and left through holes to extend downwardly and outwardly of said bottom wall;

a partition member having: an upper end integrally formed with said bottom wall of said plug-in base and interposed between said right and left through holes; a lower end extending downwardly from said upper end in the axial direction; right and left facing surfaces that are opposite to each other in the first transverse direction, and that are respectively proximate to said second and first lead-in wires, each of said right and left facing surfaces extending from said upper end to said lower end; and front and rear abutting surfaces opposite to each other in a second direction transverse to both of the first transverse direction and the axial direction, each of said front and rear abutting surfaces extending from said upper end to said lower end;

right and left urging lugs respectively disposed on said right and left facing surfaces, and including bottom through holes which are communicated with said right and left through holes in said bottom wall of said plug-in base to permit said second and first lead-in wires led out of said bottom wall to be disposed outboard to said right and left urging lugs in the first transverse direction;

a housing including an upper end wall which confines an opening for passage of said plug-in base, a lower end wall which is opposite to said upper end wall in the axial direction and which includes an inner peripheral portion defining a slot that is adapted to receive two insulated electric leads inserted therein, each of the insulated electric leads having a contact end that extends through said slot towards said upper end wall, and an inner intermediate circumferential surface which defines a passageway extending in the axial direction to communicate said opening with said slot, wherein said inner peripheral portion includes front and rear grip surfaces that are spaced apart from each other in the second transverse direction by a distance such that when said plug-in base is inserted into said housing via said opening, said partition member is guided along said passageway with said front and rear abutting surfaces thereof oriented to mate with and to be retained by said front and rear grip surfaces, respectively, so as to divide said slot into two separate inserting holes adapted for passage of the insulated electric leads therethrough, said inner intermediate circumferential surface and each of said right and left facing surfaces confining a receiving channel for accommodating each of the contact ends extending thereinto, when said partition member is inserted into said passageway downwardly in the axial direction from said opening, said right and left urging lugs respectively urging said second and first lead-in wires outwardly in the first transverse direction such that said second and first lead-in wires abut against the contact ends extended into said receiving channels and such that said second and first lead-in wires and the contact ends are clamped between said intermediate circumferential surface and said right and left urging lugs, said housing comprising an annular shoulder portion disposed on and extending inwardly and radially from said inner intermediate circumferential surface, said annular shoulder portion and said opening confining an upper annular socket portion having a first dimension and a lower annular socket portion having a second dimension which is smaller than said first dimension such that an annular seat is defined between said upper and lower annular socket portions in the axial direction, said second dimension being such that said plug-in base can be pressed fittingly into said lower annular socket portion; and a light transmissive member which includes a transmissive body confining a through hole chamber therein to enclose said miniature incandescent lamp, and an annular neck portion integrally formed with said transmissive body and disposed to provide access to said through hole chamber, said annular neck portion being sized to fit into said upper annular socket portion, and including an annular edge portion distal to said transmissive body, said annular edge portion being disposed to sit on said annular seat and abut against said plug-in base when said annular neck portion is fitted into said upper annular socket portion of said housing.

2. A decorative lighting device according to claim 1, wherein said annular neck portion of said light transmissive member is in threaded engagement with said upper annular socket portion of said housing.

3. A decorative lighting device according to claim 1, wherein said plug-in base, said partition member, said right and left urging lugs, and said housing are formed from a thermoplastic material.

4. A decorative lighting device according to claim 1, wherein said lower end of said partition member extends downwardly and outwardly of said lower end wall.

5. A decorative lighting device according to claim 1, wherein each of said right and left facing surfaces of said partition member includes a guide groove extending from said upper end to said lower end and adapted to guide insertion of the respective one of the insulated electric leads.

6. A decorative lighting device according to claim 1, wherein said front and rear grip surfaces of said inner peripheral portion of said housing respectively extend upwardly along said inner intermediate circumferential surface in the axial direction and are disposed to be in a key-and-keyway engagement with said front and rear abutting surfaces of said partition member, respectively.

* * * * *